US007992720B2

(12) United States Patent
Blaha et al.

(10) Patent No.: US 7,992,720 B2
(45) Date of Patent: Aug. 9, 2011

(54) CHIP SORTING DEVICE

(75) Inventors: Ernst Blaha, Tullnerbach (AT); Peter Krenn, Neufeld (AT)

(73) Assignee: Shuffle Master GmbH & Co KG, Vienna (AT)

( * ) Notice: Subject to any disclaimer, the term of this patent is extended or adjusted under 35 U.S.C. 154(b) by 389 days.

(21) Appl. No.: 11/004,006

(22) Filed: Dec. 3, 2004

(65) Prior Publication Data

US 2005/0280212 A1 Dec. 22, 2005
US 2011/0001290 A9 Jan. 6, 2011

Related U.S. Application Data

(63) Continuation of application No. PCT/AT03/00149, filed on May 26, 2003.

(30) Foreign Application Priority Data

Jun. 5, 2002 (AT) ..... GM359/2002

(51) Int. Cl.
*B07C 1/00* (2006.01)

(52) U.S. Cl. ..... 209/651; 209/580; 453/24

(58) Field of Classification Search ..... 209/576, 209/580, 651, 652; 453/6, 10, 12, 13, 15, 453/19–28, 33, 37, 38, 43, 44, 48
See application file for complete search history.

(56) References Cited

U.S. PATENT DOCUMENTS 1,813,296 A 7/1931 Kidwell
1,947,456 A 2/1934 Bock
2,020,293 A 11/1935 Adelstein
2,904,151 A 9/1959 Johnson
3,143,118 A 8/1964 Haines
3,371,761 A 3/1968 Ryo
(Continued)

FOREIGN PATENT DOCUMENTS

AT 006 405 10/2003
(Continued)

OTHER PUBLICATIONS

English Translation of IT 94 A001040; Inv: Abbiatti et al.; Pub. Date: Dec. 20, 1994.*
(Continued)

*Primary Examiner* — Joseph C Rodriguez
*Assistant Examiner* — Kalyanavenkateshware Kumar
(74) *Attorney, Agent, or Firm* — TraskBritt

(57) ABSTRACT

A sorting device for the sorting of gaming chips comprises a base frame, a collection container, an oblique transport disc adjoining the collection container, the oblique transport disc separating and receiving gaming chips, a gaming chip characteristic identification system positioned adjacent the transport disc, a transfer device distributing the gaming chips in removal units according to characteristics identified in the gaming chip characteristic identification system. The sorting device has a transport for transferring the gaming chips directly from the transport disc to the removal units, and a radially external region of the transport disc contains recesses into which the gaming chips are separated. The sorting device is provided with at least one ejector that can be inserted at least partially from one side of the transport disc into the recesses to lift an edge of the gaming chips above a front face of the transport disc lying opposite the at least one ejector, whereby a blade located on a removal unit slides under the gaming chip with a lifted edge, and the gaming chip with a lifted edge is placed on the blade.

6 Claims, 4 Drawing Sheets

U.S. PATENT DOCUMENTS

| | | | | |
|---|---|---|---|---|
| 3,435,833 | A | 4/1969 | Tanaka | |
| 3,583,410 | A | 6/1971 | Bayha et al. | |
| 3,680,566 | A | 8/1972 | Tanaka et al. | |
| 3,766,452 | A | 10/1973 | Burpee et al. | |
| 3,771,538 | A | 11/1973 | Reis | 453/12 |
| 3,827,582 | A | 8/1974 | Lederer | |
| 4,157,139 | A | 6/1979 | Björk | |
| 4,161,381 | A | 7/1979 | Sciortino | |
| 4,209,960 | A | 7/1980 | Deutschländer et al. | |
| 4,275,751 | A | 6/1981 | Bergman | 453/5 |
| 4,360,034 | A | 11/1982 | Davila et al. | 453/8 |
| 4,531,531 | A | 7/1985 | Johnson et al. | 453/10 |
| 4,543,969 | A | 10/1985 | Rasmussen | 453/10 |
| 4,607,649 | A | 8/1986 | Taipale et al. | 453/6 |
| 4,681,128 | A | 7/1987 | Ristvedt et al. | 453/6 |
| 4,731,043 | A | 3/1988 | Ristvedt et al. | 453/6 |
| 4,775,354 | A | 10/1988 | Rasmussen et al. | 453/10 |
| 4,863,414 | A | 9/1989 | Ristvedt et al. | 453/6 |
| 4,966,570 | A | 10/1990 | Ristvedt et al. | |
| 5,011,455 | A | 4/1991 | Rasmussen | |
| 5,011,456 | A | 4/1991 | Kobayashi et al. | |
| 5,022,889 | A | 6/1991 | Ristvedt et al. | |
| 5,042,810 | A | 8/1991 | Williams | |
| 5,141,443 | A | 8/1992 | Rasmussen et al. | 453/10 |
| 5,166,502 | A | 11/1992 | Rendleman et al. | |
| 5,207,612 | A | 5/1993 | Wollaston | |
| 5,277,651 | A | 1/1994 | Rasmussen et al. | |
| 5,406,264 | A | 4/1995 | Plonsky et al. | |
| 5,460,295 | A | 10/1995 | Law | |
| 5,472,074 | A | 12/1995 | Milcetic | |
| 5,531,331 | A | 7/1996 | Barnett | |
| 5,551,542 | A | 9/1996 | Stockli | |
| 5,624,308 | A | 4/1997 | Rumbach | 453/3 |
| 5,651,548 | A | 7/1997 | French et al. | |
| 5,735,742 | A | 4/1998 | French | |
| 5,755,618 | A | 5/1998 | Mothwurf | |
| 5,757,876 | A | 5/1998 | Dam et al. | |
| 5,770,533 | A | 6/1998 | Franchi | |
| 5,781,647 | A | 7/1998 | Fishbine et al. | |
| 5,827,117 | A | 10/1998 | Naas | |
| 5,836,583 | A | 11/1998 | Towers | |
| 5,865,673 | A | 2/1999 | Geib et al. | |
| 5,895,321 | A | 4/1999 | Gassies et al. | |
| 5,931,732 | A | 8/1999 | Abe et al. | |
| 5,933,244 | A | 8/1999 | Kiritchenko | |
| 5,947,257 | A | 9/1999 | Schwartz | |
| 5,950,796 | A | 9/1999 | Kobayashi | |
| 5,957,262 | A | 9/1999 | Molbak et al. | |
| 5,957,776 | A | 9/1999 | Hochne | |
| 6,021,949 | A | 2/2000 | Boiron | |
| 6,075,217 | A | 6/2000 | Kiritchenko | |
| 6,080,056 | A | 6/2000 | Karlsson | 453/3 |
| 6,168,001 | B1 | 1/2001 | Davis | |
| 6,186,895 | B1 | 2/2001 | Oliver | |
| 6,193,599 | B1 | 2/2001 | Kurosawa et al. | |
| 6,260,757 | B1 | 7/2001 | Strisower | |
| 6,264,109 | B1 | 7/2001 | Chapet et al. | |
| 6,283,856 | B1 | 9/2001 | Mothwurf | |
| 6,296,190 | B1 | 10/2001 | Rendleman | |
| 6,313,871 | B1 | 11/2001 | Schubert | |
| 6,381,294 | B1 * | 4/2002 | Britton | 377/7 |
| 6,464,584 | B2 | 10/2002 | Oliver | |
| 6,506,115 | B1 | 1/2003 | Mothwurf | |
| 6,532,297 | B1 | 3/2003 | Lindquist | |
| 6,540,602 | B2 | 4/2003 | Adams et al. | |
| 6,567,159 | B1 | 5/2003 | Corech | |
| 6,572,474 | B2 | 6/2003 | Rudd | |
| 6,581,747 | B1 | 6/2003 | Charlier et al. | |
| 6,592,445 | B2 | 7/2003 | Lee | |
| 6,629,591 | B1 | 10/2003 | Griswold et al. | |
| 6,733,388 | B2 | 5/2004 | Mothwurf | |
| 6,753,830 | B2 | 6/2004 | Gelbman | |
| 6,772,870 | B2 | 8/2004 | Sugai et al. | 194/217 |
| 6,976,589 | B2 | 12/2005 | De Raedt et al. | 209/552 |
| 7,004,831 | B2 | 2/2006 | Hino et al. | |
| 7,014,554 | B1 | 3/2006 | Fletcher et al. | |
| 7,066,335 | B2 | 6/2006 | Aas et al. | |
| 2004/0149539 | A1 | 8/2004 | De Raedt et al. | |
| 2005/0155838 | A1 | 7/2005 | De Raedt et al. | 194/302 |
| 2005/0280212 | A1 | 12/2005 | Blaha et al. | |
| 2007/0212996 | A1 | 9/2007 | Ryou | |

FOREIGN PATENT DOCUMENTS

| | | |
|---|---|---|
| AT | 006 546 | 12/2003 |
| CA | 2090073 | 8/1994 |
| CA | 2229054 | 8/1996 |
| CA | 2229053 | 10/1996 |
| DE | 4240886 | 7/1994 |
| EP | 0424355 | 11/1994 |
| EP | 0631260 | 12/1994 |
| EP | 0757582 | 2/1997 |
| EP | 0806020 | 12/1998 |
| EP | 1080348 | 8/2002 |
| EP | 0823041 | 9/2002 |
| EP | 0950989 | 9/2003 |
| EP | 1050024 | 3/2004 |
| FR | 2 749 093 | 11/1997 |
| FR | 2 752 078 | 10/1998 |
| GB | 1 255 492 | 12/1971 |
| GB | 1 571 219 | 7/1980 |
| GB | 2 061 490 | 5/1981 |
| GB | 2 198 274 | 6/1988 |
| GB | 2 203 582 | 10/1988 |
| GB | 2 254 419 | 10/1992 |
| GB | 2 333 632 | 7/1999 |
| IT | 94 A001040 | 12/1994 |
| IT | TO941040 | 12/1994 |
| WO | WO 91/17842 | 11/1991 |
| WO | WO/92/11953 | 7/1992 |
| WO | WO 95/28996 | 11/1995 |
| WO | WO 96/23281 | 8/1996 |
| WO | WO 96/34258 | 10/1996 |
| WO | WO 99/38126 | 7/1999 |
| WO | WO 99/60353 | 11/1999 |
| WO | WO 92/11953 | 7/2002 |
| WO | WO 03/049045 | 6/2003 |
| WO | WO 03/103860 | 12/2003 |
| WO | 2004009256 A1 | 1/2004 |

OTHER PUBLICATIONS

International Search Repot dated Mar. 6, 2008, for International Application No. PCT/EP2007/008873 (3 pages).

Cover sheet of 1993 video tape.

Training handouts from Jan. 1994.

Huxley's advertisement for Chipmaster: Huxley's count on the Chipmaster deal, ("Casino World" is distributed in the U.S.) Mar. 1994.

Show report Monte Carlo by Christian Pohanka (the inventor), Mar. 23, 1993.

Trial installation at Holland Casinos, report by Christian Pohanka, Sep. 29, 1993.

Report from Spain by Christina Pohanka, Sep. 26, 1993.

Photograph of first installation at Casino Baden (Austria), Jan. 4, 2004.

Photograph of first installation at Holland Casinos, Jan. 4, 2004.

Photograph of first installation at Valencia (Spain) , Jan. 4, 2004.

Photograph of Chipmaster production at VICOMA, Vienna, Jan. 4, 2005.

Photographs of Chipmaster in Paulson Booth at Apr. 26-27, 1994 Show.

PCT International Search Report for International Application No. PCT/US04/02331 (2 pages).

* cited by examiner

CHIP SORTING DEVICE

RELATED APPLICATION DATA

This application is a continuation of International Patent Application No. PCT/AT03/00149 filed May 26, 2003, and published as International Publication Number WO 03/103860A1 on Dec. 18, 2003, which in turn claims priority to Austrian Application No. 359/2002 filed Jun. 5, 2002, now Austrian Patent AT 006 405.

BACKGROUND OF THE INVENTION

1. Field of the Invention

The Invention refers to a chip-sorting device for gaming chips and counters, specifically those of varying colors and according to the overall concept of Claim 1.

2. Background of the Art

Sorting devices for gaming chips have been well known for a long time. In GB2061490, a patent for a sorting device was published, whereby gaming chips were gasped by a conveyor chain and passed by a characteristic recognition system. This approach is disadvantageous in its requirement for considerable space, specifically for the chain. It is further disadvantaged by the high manufacturing costs, as the chain is comprised of many individual links that are additionally provided with spring-loaded bolts, for the dispensing of the gaming chips.

GB2254419 describes a sorting device, whereby the gaming chips are held by a transport disc and subsequently transferred to a chain, where they are recognized and gathered together, to be distributed. This arrangement requires less space than the aforementioned. This relies upon elastic components in order to hold individual chips for transfer from the disc to the chain and in the chain itself. It is these elastic elements that permit only certain-sized chips to pass through—the gaming chips that are larger than the designated threshold diameter are a mechanical burden/load to the system and are never distributed/transferred to the chain. The gaming chips smaller than the designated diameter cannot be grasped by the chain; therefore, additional chain is necessary, leading to higher manufacturing costs.

U.S. Pat. No. 6,381,294 is a well-known chip-sorting device whereby the advancement of the chips is brought about by a chain that is expensive to maintain.

SUMMARY OF THE INVENTION

The goal of this Invention is avoiding these disadvantages and putting forth a chip-sorting device of a different type, which has lower manufacturing costs and utilizes less space, and thereby, is able to handle sorted gaming chips and counters of vastly differing dimensions.

Consistent with such an Invention would be this Sorting Plan/Proposal that introduces the aforementioned type of device that achieves the designated characteristics of the claims. This describes a sorting device for the sorting of gaining chips comprising a base frame 36, a collection container 1, an oblique transport disc 3 adjoining the collection container 1, the oblique transport disc 3 separating and receiving gaming chips 27, a gaming chip characteristic identification system (not depicted) positioned adjacent the transport disc 3, a transfer device 11 distributing the gaming chips 27 in removal units 12 according to characteristics identified in the gaming chip characteristic identification system, removal units 12 having a U-shaped cross-section, the sorting device having a transport for transferring the gaming chips 27 directly from the transport disc 3 to the removal units 12, and a radially external region of the transport disc 3 containing recesses 8 into which the gaming chips 27 are separated, the sorting device provided with at least one ejector 14 that can be inserted at least partially from one side of the transport disc 3 into the recesses 8 to lift an edge 15 of the gaming chips 27 above a front face of the transport disc 3 lying opposite the at least one ejector 14, whereby a blade 16 located on a removal unit 12 slides under the gaining chip 27 with a lifted edge, and the gaming chip 27 with a lifted edge is placed on the blade 16.

A sorting device for the sorting of gaming chips 27 has a base frame 36, a collection container 1 an oblique transport disc 3 adjoining the collection container 1, the oblique transport disc 3 separating and receiving gaming chips 27, a gaming chip characteristic identification system positioned adjacent the transport disc 3, a transfer device 11 distributing the gaming chips 27 in removal units 12 according to characteristics identified in the gaming chip characteristic identification system, removal units 12 having a U-shaped cross-section, the sorting device having a transport for transferring the gaming chips 27 directly from the transport disc 3 to the removal units 12, and a radially external region of the transport disc 3 containing recesses 8 into which the gaming chips 27 are separated, the soiling device provided with at least one ejector 14 that moves so as to be inserted at least partially from one side of the transport disc 3 into the recesses 8 to lift an edge 15 of the gaming chips 27 above a front face of the transport disc 3 lying opposite the at least one ejector 14, whereby a blade 16 located on a removal unit 12 slides under the gaining chip 27 with a lifted edge, and the gaming chip 27 is placed on the blade 16.

Through the proposed measures, there is the possibility to advance and sort gaining chips and counters of varying dimensions, using a cost efficient and simple method. The technically expensive and maintenance-intensive use of the chain is not advantageous. That sorting device is not sensitive to the varied sizes of gaming chips and counters. During the elevation of the chips and the simultaneous rotation of the transport disc, the chips are automatically removed from the transport disc and organized within removal units.

Thereby, there is, through the features of an ejector 14, suitably rotatable, a substantially L-shaped lever, the shorter arm of which can be inserted into the recesses 8 and the rotating movement of the ejector 14 is controlled by means of a cam 19, the advantage of clean and gentle delivery of the gaming chips 27 into the removal units.

Referring to the collection container 1, the side of the transport disc 3 not adjacent to this container has a cogwheel 22. Via a preferably magnetic coupling 24, the cam 19 drives a pinion 23 to render it certain that the distribution movement for a single gaining chip 27 or counter, relative to the movement of the transport disc 3, is always constant, even when the transport speed is altered or adjusted.

Through the features wherein the magnetic coupling 24 may be activated by a microprocessor, the organization of the gaming chips 27, in conjunction with the characteristic recognition system, can be easily programmed and regulated.

Through the features wherein every removal unit 12 and ejector 14 is arrayed with a magnetic coupling 24 and pinion 23, several removal discs can be loaded.

The removal unit 12 has a removal device that is arrayed, which covers a fundamentally L-shaped removal lever's 28 longer arm **28*a*. The arm 28*a* is in a groove that runs the length of the floor of the removal unit 12 and goes under where the gaming chips 27 and counters are found. These features allow a portion of the sorted gaming chips 27 and counters to be easily and readily removed from the removal units 12**.

Through the features of a shorter arm 29 of the removal lever 28 moving in the direction of the longer arm 28*a* or that the movement of the shorter arm 29 along the longer arm 28*a* is governed by an adjustable screw 30, the number of gaming chips 27 and counters removed from the removal units 12 can be set. Toward this end, the movement arc of the removal lever 28, with reference to a removal lever 28 that may swivel around an axle 31 at a parallel level to the movement direction of the shorter arm 29, is anticipated.

Through the features of the shorter arm 29 of the removal lever 28 encountering a spring 33, which pushes the shorter arm 29 against the gaming chips 27 and counters, the removal lever 28 lies in close proximity to the gaming chips 27 and counters.

Through the features of each removal unit 12 having a sensor 35 to detect when the removal unit 12 is at full level, it can be reliably determined when the removal unit 12 has reached full capacity.

Based upon the designated characteristics of the rotation speed of the transport disc 3 determining the success rate of the characteristic recognition system in identifying gaming chips 27 and counters, the rate of advancement/transport of the gaming chips 27 and counters is appropriate for the system.

The designated characteristics of the characteristic recognition system utilizing sensors to differentiate size and color combinations of gaming chips 27 and counters and a spectrometer being placed in the characteristic recognition system, to differentiate wavelengths of the colors undetectable by the human eye describe the characteristic recognition system that is preferably employed.

Through the designated characteristics of the base frame 36 being on roller/casters 37, the base frame 36 has the capability to be adjusted for varying table heights.

BRIEF DESCRIPTION OF THE DRAWINGS

The invention is better illustrated by the drawings as follows.

DETAILED DESCRIPTION OF THE INVENTION

Figure 1:
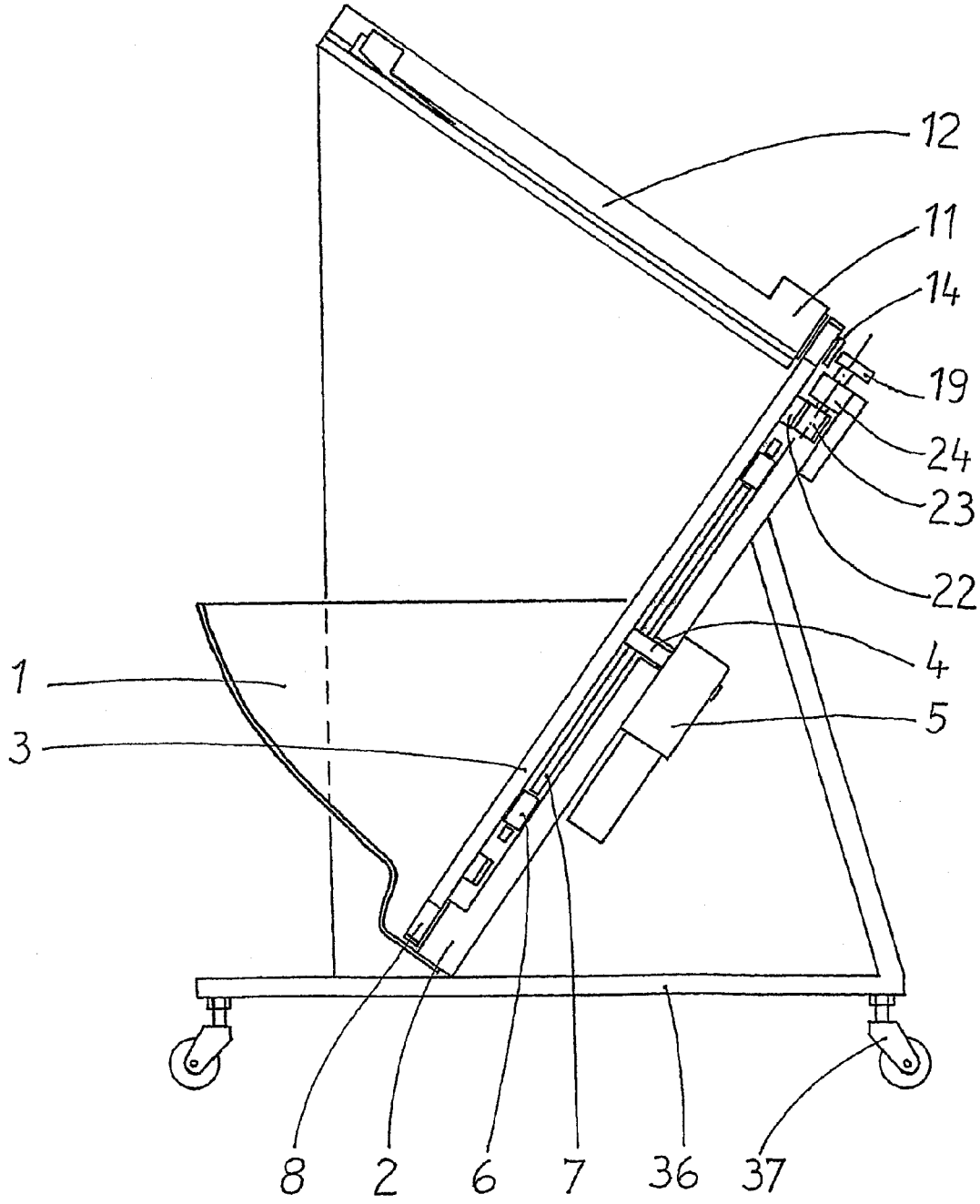
FIG. 1 is a schematic drawing of the invention without its housing.

The device consists of a collection container 1 (also called a hopper), open from above, for played gaming chips and counters, attached to the base frame 2.

The advancement transport outfitting is comprised of a circular collection disc 3, and is mounted tightly on a drive axle. An axle 4 is housed in the base frame 2 and is connected to a motor 5.

The collection disc 3 is driven by a number of cylinder bodies/rollers 6 housed in caged frames 7 and arrayed axially. This axial array may be overridden if the central axle 4 is frozen.

Figure 5:
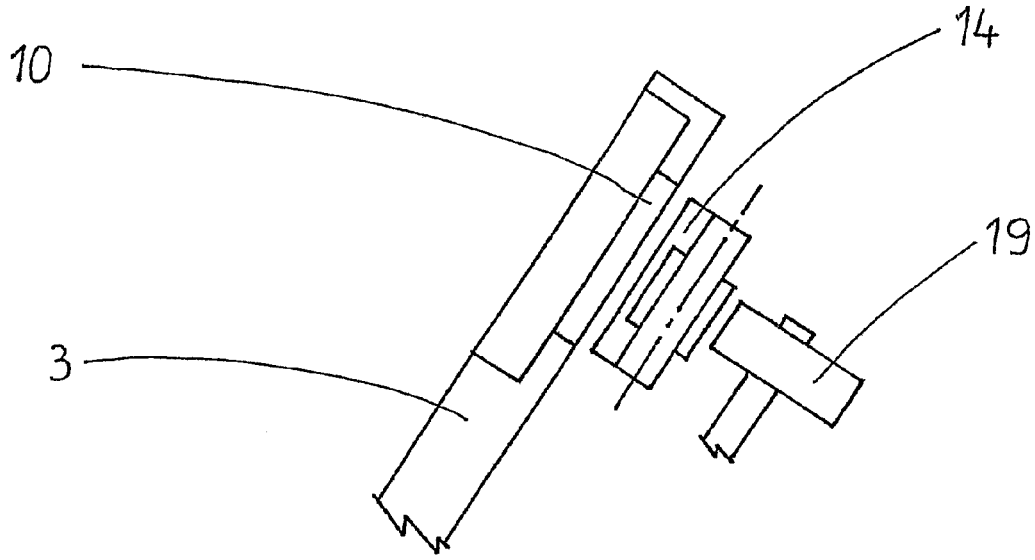
FIG. 5 is an alternative depiction of the collection disc.

In practice, the gaming chips 27 and counters are collected in the hopper 1, where they fall to the lowest point/bottom by gravity and are taken up within recesses 8 in the collection disc 3. The openings in the collection disc 3 display at least the diameter of the largest chips for processing of the desired round gaming chips 27 or counters. The depth of the cavities is set by the thickness of the collection disc 3. By the use of round holes, the gaming chips 27 and counters slide into the holes during the rotation of the collection disc 3 onto the base frame 2. FIG. 5 demonstrates an alternative collection of gaming chips 27 and counters in sack holes, which open on the side of the hopper 1 and are enclosed on the side of the base frame 2. Thereby, the back of the collection disc 3 must have a circular groove 10 that is approximately the width of the ejector 14.

The collection disc 3 advances the gaming chips 27 and counters optionally serially/in rows at an angle of approximately 135 degrees from above; whereby, they are passed before a color sensor, which detects the combination of color and size variations. Depending upon chip color and design, the sensor conveys a signal to the regulating microprocessor. This regulating microprocessor decides, based upon programmable organization of colors, upon routing the gaming chips 27 and counters into the appropriate removal units 12.

Alternatively, recognition of the gaming chips 27 and counters can be achieved through a spectrometer in the characteristic recognition system, which differentiates based upon wavelength undetectable to the human eye. In order to accomplish this, the gaming chips 27 and counters must be pigment coded.

After recognition, the distribution of the gaining chips 27 and counters into the removal units 12 is effected. This activity covers about 90 degrees of the collection disc 3.

Figure 4:
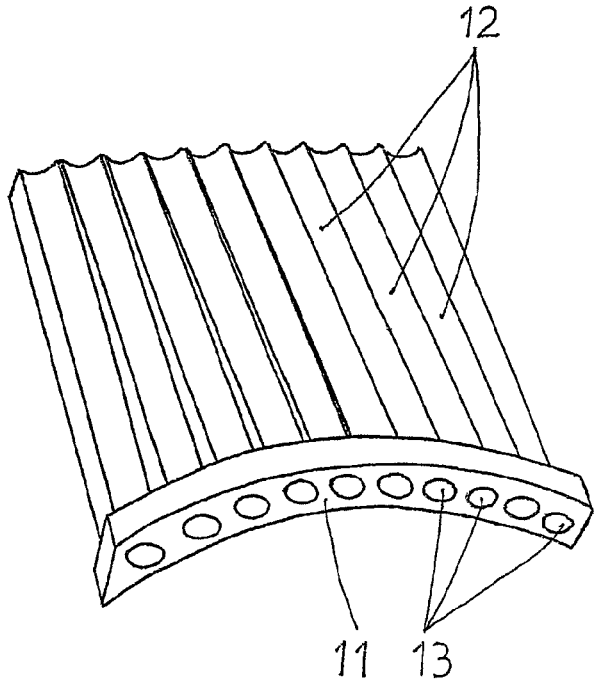
FIG. 4 is a possible enlarged view of the removal units.

FIG. 4 demonstrates, as an arc-like portion of the transfer device 11, the display of a number of openings 13, in which different gaming chips 27 and counters are sorted from the collection disc 3 into removal units 12. In this detailed example, ten openings 13 are used.

Figure 2:
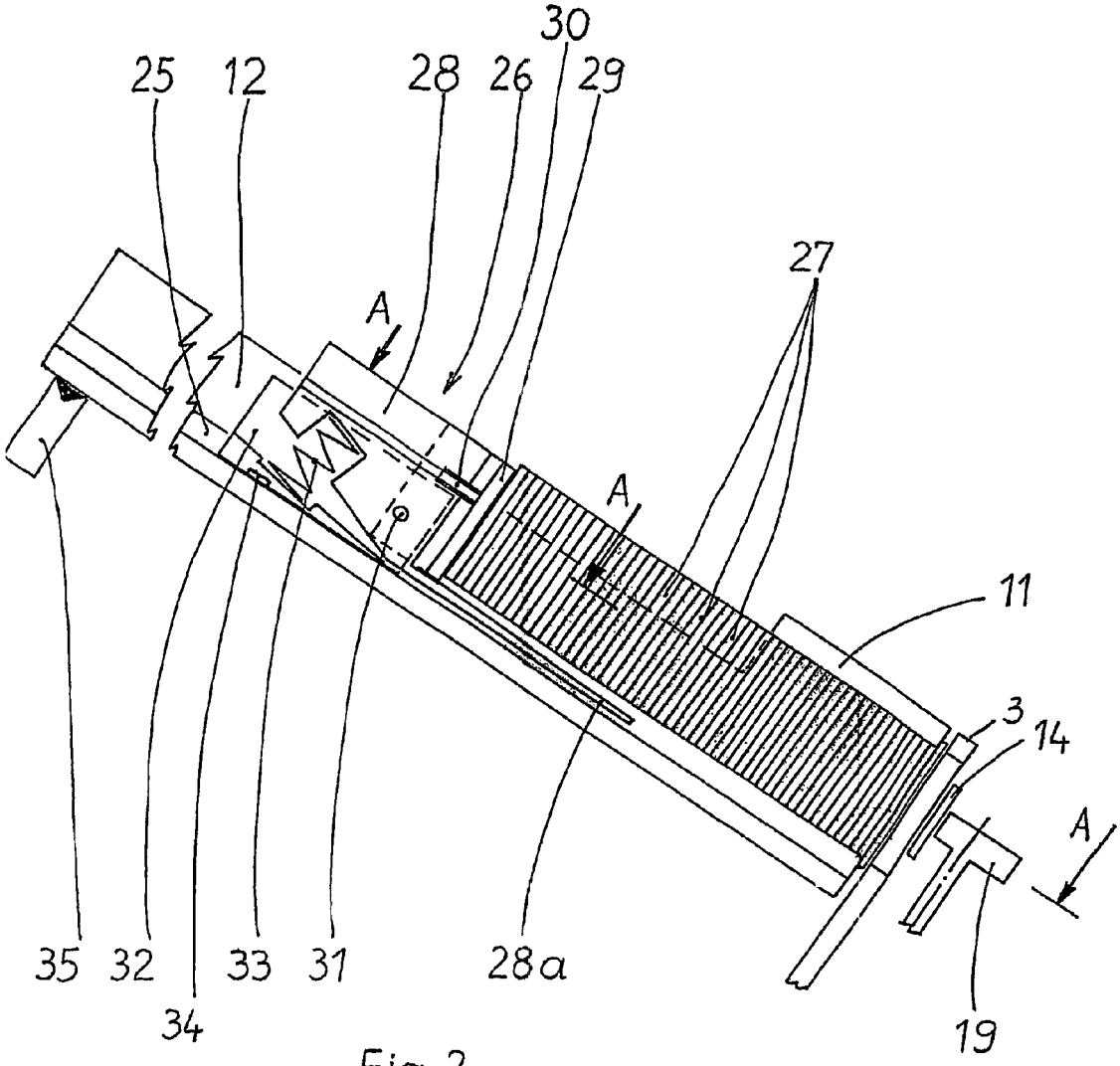
FIG. 2 is a cross-section through the removal unit.
Figure 3:
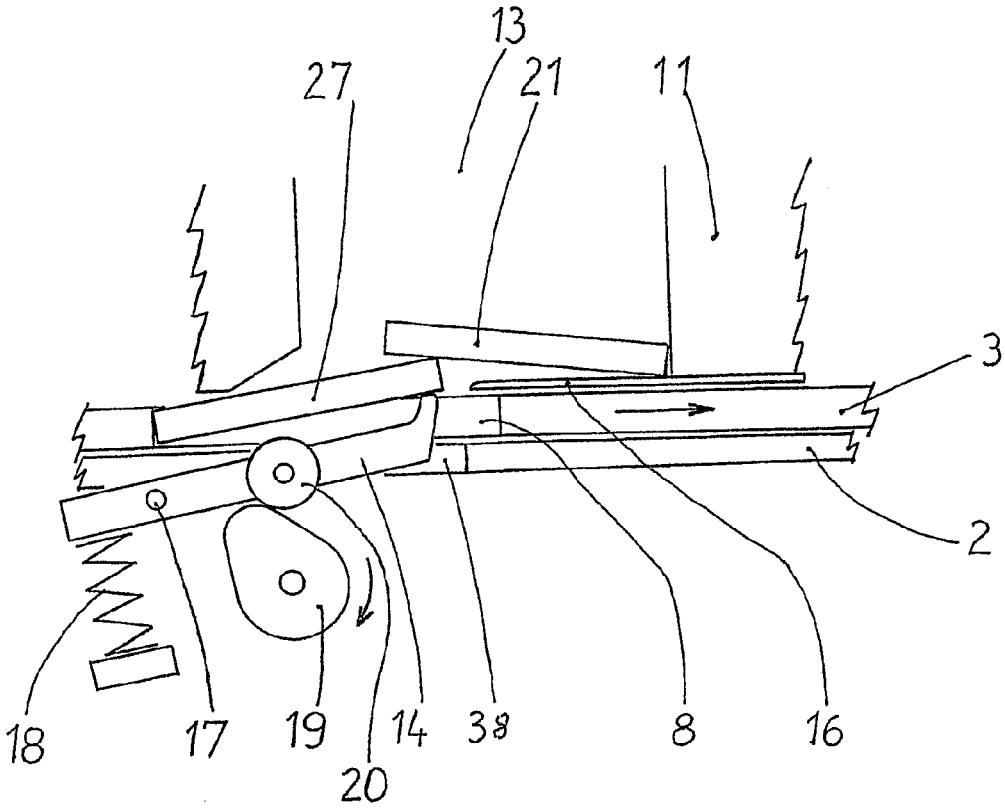
FIG. 3 is a cut-away through the chip distribution unit.

The actual distribution of gaining chips 27 and counters is well viewed in FIG. 3, shown as a cut-away along the line A-A from FIG. 2 through one of the openings 13 in the transfer device 11. Each of the openings 13 is arranged with an ejector 14, which after activation is inserted into the recesses 8 through a slit 38 in the base frame 2. The collection disc 3 lifts the specific gaming chip 27 or counter. The ejector 14 is mounted so that it may swivel around the axle 17 and, via spring 18 action, is pushed against the cam 19. A roller/cylinder 20 facilitates the free closure of the cam 19 against the ejector 14.

Through continuous movement of the collection disc 3, the gaming chips 27 or counters are pushed onto the blade 16, where they rest/remain. As another counter 21 finds itself on the blade 16, it is ultimately lifted, and the earlier counter is placed underneath the latter. This process repeats until the removal unit 12 is filled with gaming chips 27 or counters of the same type.

FIG. 4 demonstrates the removal units 12 directly adjacent to the transfer device 11. These units go, in practical fashion, from an arc-like arrangement, with respect to the device, to a straight or nearly straight arrangement next to one another to facilitate the easy removal of gaming chips 27 or counters from all sides.

In FIG. 1, the drive assembly of the cam 19 is visible. With reference to the collection disc 3, the side of the collection disc 3 away from the collection container 1 contains a ring-formed cogwheel 22 that drives the pinion 23 and cam 19. The microprocessor establishes the magnetic coupling 24 between the can 19 and the pinion 23. It is assured that the ejector 14 has the same movement relative to the collection disc 3, which is independent of the speed of the collection disc 3.

In case of a jam during the transfer of the gaming chips 27 and counters into the removal units 12 a brief decline/drop of the collection disc 3 may be anticipated. Toward recognition of a jam, the power of the motor 5 may be monitored, or the sensor of the collection disc 3 may be queried/assessed.

Toward the furtherance of the transport function and the simultaneous reduction of wear-and-tear on all the moving parts of the machine, it is recommended that suitable transport speed of the machine be maintained, with respect to the quantity of gaming chips and counters to be sorted. The setting of the speed can influence the rate (if and how many) of free chips, that is, not in the recesses 8 of the collection disc 3.

The removal units 12 for sorted gaming chips 27 and counters are visible in FIG. 2 and are comprised of open-top chip transporters, each respectively provided with a central groove 25. For practical removal of gaming chips 27 and counters from the removal units 12, there is a specialized device provided, "cutter" 26, which glides through the groove 25 via gravity underneath to where the reserve gaming chips 27 and counters are located in the removal units 12. The cutter 26 contains an L-shaped developed/advanced lever 28, whose longer arm 28*a* lies underneath the gaming chips 27 and counters. At the same time, a shorter arm 29 is always applied to the gaming chips 27 and counters and props/supports itself, for its part, via an adjustable screw 30. The lever 28 and shorter arm 29 are able to swivel and are connected via an axle 31 with main bodies 32 gliding within the groove 25. Through pressure applied in the direction of arrow A, a specific quantity of gaming chips 27, preferably 20 pieces of gaming chips 27 or counters, can be picked up by the longer arm 28*a* of the L-shaped lever 28 and are thus free to be taken away from the accumulation of gaming chips 27 and counters.

With the adjustable screw 30, the quantity of gaming chips 27 and counters lifted out by the "cutter" 26 can be finely adjusted/regulated.

The insertion of a pressure spring 33 assures that the thin shank of the L-shaped lever 28 remains underneath the counters 21; however, it is not absolutely required.

In order to prevent overfilling of the removal units 12 with gaming chips 27 or counters, every removal unit 12 is provided with a sensor 35. As soon as the "cutter" 26 reaches its endpoint, a sensor delivers a signal to the microprocessor regulation, which prevents further delivery of gaming chips 27 and counters to the unit in question. The sensor 35 can, for example, be either an optical or magnetic sensor. In order to achieve this, a permanent magnet 34 must be embedded in the floor of the cutter 26. The device can be adjusted to different heights with a variety of means in FIG. 1, the casters 37 on the base frame 36 are extremely adjustable.

What is claimed is:

1. A sorting device for the sorting of gaming chips comprising:

a base frame;

a collection container;

an oblique transport disc adjoining the collection container, the oblique transport disc separating and receiving gaming chips;

a gaming chip characteristic identification system positioned adjacent the transport disc;

a transfer device distributing the gaming chips to removal units according to characteristics identified in the gaming chip characteristic identification system, removal units having a U-shaped cross-section;

the sorting device having a transport for transferring the gaming chips directly from the transport disc to the removal units; and a radially external region of the transport disc containing recesses into which the gaming chips are separated, the sorting device provided with at least one ejector that can be inserted at least partially from one side of the transport disc into the recesses to lift an edge of the gaming chips above a front face of the transport disc lying opposite the at least one ejector, whereby a blade located on a removal unit slides under the gaming chip with a lifted edge, and the gaming chip with a lifted edge is placed on the blade wherein a side of the transfer disc not adjacent to the collection container has a cogwheel.

2. The sorting device of claim 1, further comprising a coupling adjacent the cogwheel.

3. The sorting device of claim 2, wherein there is a cam that drives a pinion adjacent the coupling.

4. The sorting device of claim 2, wherein the coupling comprises a magnetic coupling.

5. The sorting device of claim 4, wherein the magnetic coupling is activated by a microprocessor.

6. A sorting device for the sorting of gaming chips comprising:

a base frame;

a collection container;

an oblique transport disc adjoining the collection container, the oblique transport disc separating and receiving gaming chips;

a gaming chip characteristic identification system positioned adjacent the transport disc;

a transfer device distributing the gaming chips in removal units according to characteristics identified in the gaming chip characteristic identification system, removal units having a U-shaped cross-section, the sorting device having a transport for transferring the gaming chips directly from the transport disc to the removal units; and a radially external region of the transport disc containing recesses into which the gaming chips are separated, the sorting device provided with at least one ejector that moves so at least one portion of the at least one ejector is inserted at least partially from one side of the transport disc into the recesses to lift an edge of the gaming chips above a front face of the transport disc lying opposite the at least one ejector;

whereby a blade located on a removal unit slides under the gaming chip with the lifted edge, and the gaming chip with the lifted edge is placed on the blade, the at least one ejector comprising an L-shaped lever having two arms comprising a longer arm and a shorter arm, the shorter arm positioned for insertion into the recesses;

wherein movement of the shorter arm along the longer arm is governed by an adjustable screw.

* * * * *

UNITED STATES PATENT AND TRADEMARK OFFICE

CERTIFICATE OF CORRECTION

PATENT NO. : 7,992,720 B2
APPLICATION NO. : 11/004006
DATED : August 9, 2011
INVENTOR(S) : Ernst Blaha et al.

It is certified that error appears in the above-identified patent and that said Letters Patent is hereby corrected as shown below:

On the title page:

In ITEM (56) References Cited

OTHER PUBLICATIONS

Page 2, 2nd column, 1st line of the 1st entry (line 50), change "Repot" to --Report--

In the specification:

| | | |
|---|---|---|
| COLUMN 2, | LINE 9, | change "gaining" to --gaming-- |
| COLUMN 2, | LINE 53, | change "gaining" to --gaming-- |
| COLUMN 4, | LINE 33, | change "gaining" to --gaming-- |

Signed and Sealed this
First Day of October, 2013

Teresa Stanek Rea

Teresa Stanek Rea
*Deputy Director of the United States Patent and Trademark Office*